US009477188B2

(12) United States Patent
Kadowaki

(10) Patent No.: US 9,477,188 B2
(45) Date of Patent: Oct. 25, 2016

(54) FIXING DEVICE

(71) Applicant: CANON KABUSHIKI KAISHA, Tokyo (JP)

(72) Inventor: Hiroyuki Kadowaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/041,969

(22) Filed: Feb. 11, 2016

(65) Prior Publication Data

US 2016/0238974 A1 Aug. 18, 2016

(30) Foreign Application Priority Data

Feb. 16, 2015 (JP) ..... 2015-027830

(51) Int. Cl.
*G03G 15/20* (2006.01)

(52) U.S. Cl.
CPC ..... *G03G 15/2039* (2013.01); *G03G 15/2078* (2013.01)

(58) Field of Classification Search
CPC ..... G03G 15/2039; G03G 15/2078
See application file for complete search history.

(56) References Cited

U.S. PATENT DOCUMENTS

2012/0269535 A1* 10/2012 Mine ..... G03G 15/2053 399/90
2013/0108306 A1* 5/2013 Saito ..... G03G 15/2053 399/90
2013/0302060 A1* 11/2013 Moriya ..... G03G 21/1652 399/90
2013/0336672 A1* 12/2013 Mizuta ..... G03G 21/1867 399/75
2016/0018764 A1* 1/2016 Takagi ..... G03G 15/205 399/70

FOREIGN PATENT DOCUMENTS

JP 2795774 B2 9/1998
JP 2003337484 A 11/2003

* cited by examiner

*Primary Examiner* — David Gray
*Assistant Examiner* — Carla Therrien
(74) *Attorney, Agent, or Firm* — Canon U.S.A. Inc., IP Division

(57) ABSTRACT

A fixing device includes a film, a heater contacting the film which has a substrate, a first heat generating segment on a first surface of the substrate, and a second heat generating segment on a second surface opposite to the first surface, a pressure member forming the nip portion, a temperature detection unit detecting a temperature of the second surface, and a control unit supplying power to the heater so that the detected temperature becomes a target temperature, wherein the control unit can perform a first heater control so as to supply power only to the first heat generating segment, and a first heater control so as to supply power only to the second heat generating segment, and wherein the target temperature during performing the second heater control is higher than the target temperature during performing the first heater control.

6 Claims, 10 Drawing Sheets

FIXING DEVICE

BACKGROUND OF THE INVENTION

1. Field of the Invention

The present invention relates to a fixing device mounted on an image forming apparatus, such as a copying machine and a printer, in which an electrophotographic technology is used.

2. Description of the Related Art

A fixing device in which a film is used is known as the fixing device mounted on the image forming apparatus such as the copying machine and the printer. Typically, the fixing device includes a cylindrical film, a plate-like heater that contacts with an inner surface of the film, and a roller that constitutes a nip portion together with the heater via the film. In fixing processing of the fixing device, a recording material on which a toner image is formed at the nip portion is heated while being conveyed, whereby the toner image is fixed to the recording material. In the fixing device, since the film having a low heat capacity is used, there is a merit of shortening a warming-up time of the fixing device and contributing to the shortening of First Print Out Time (FPOT) of the image forming apparatus.

Nowadays, there is an increasing need for downsizing the image forming apparatus, and it is conceivable that the downsizing of the fixing device is achieved by further decreasing a diameter of the film or roller. However, in order to decrease the diameter of the film, it is necessary to narrow a width of the heater in a recording material conveyance direction. Therefore, Japanese Patent Application Laid-Open No. 2003-337484 discusses a fixing device including a heater in which a heat generation amount distribution can be formed according to the width of the recording material by separately disposing heating resistors having different lengths in both surfaces of a substrate of the heater even if the width of the heater is narrow. The fixing device discussed in Japanese Patent Application Laid-Open No. 2003-337484 includes a temperature detection unit for detecting a temperature at a surface on an opposite side to a surface contacting the film of the heater, and power supplied to the heating resistors provided on both the surfaces of the heater is controlled so that the temperature detected by the temperature detection unit becomes a target temperature.

However, the following problem is generated if a target temperature is the same between when the power is supplied to the heating resistor formed on one of the surfaces of the heater and when the power is supplied to the heating resistor formed on the other surface.

Sometimes a thermal resistance of a heat conduction path to the temperature detection unit from the heating resistor formed on the surface contacting with the film of the heater differs from a thermal resistance of a heat conduction path to the temperature detection unit from the heating resistor formed on the surface on the opposite side to the surface contacting with the film of the heater. When the same target temperature is set for a surface of the heater without determining to which surface the power is supplied, the surface temperature at the film differs, which results in a problem in that a fixing defect is generated.

SUMMARY OF THE INVENTION

According to an aspect of the present invention, a fixing device configured to fix a toner image onto a recording material by conveying and heating the recording material on which the toner image has been formed at a nip portion, includes a cylindrical film, a heater configured to contact the film to heat the film, and including a substrate, a first heat generating segment formed on a first surface facing the film of the substrate, and a second heat generating segment formed on a second surface that is on an opposite side to the first surface of the substrate, a pressure member configured to contact the film to form the nip portion, a temperature detection unit configured to detect a temperature of the surface on which the second heat generating segment of the heater is formed, and a control unit configured to supply power to the heater so that the temperature detected by the temperature detection unit becomes a target temperature, wherein the control unit can perform a first heater control for controlling the heater so as to supply power only to the first heat generating segment, and a first heater control for controlling the heater so as to supply power only to the second heat generating segment, and wherein the target temperature during performing the second heater control is higher than the target temperature during performing the first heater control.

Further features of the present invention will become apparent from the following description of exemplary embodiments with reference to the attached drawings.

DESCRIPTION OF THE EMBODIMENTS

Hereinbelow, exemplary embodiments of the present invention will be described with reference to the drawings.

Figure 1:
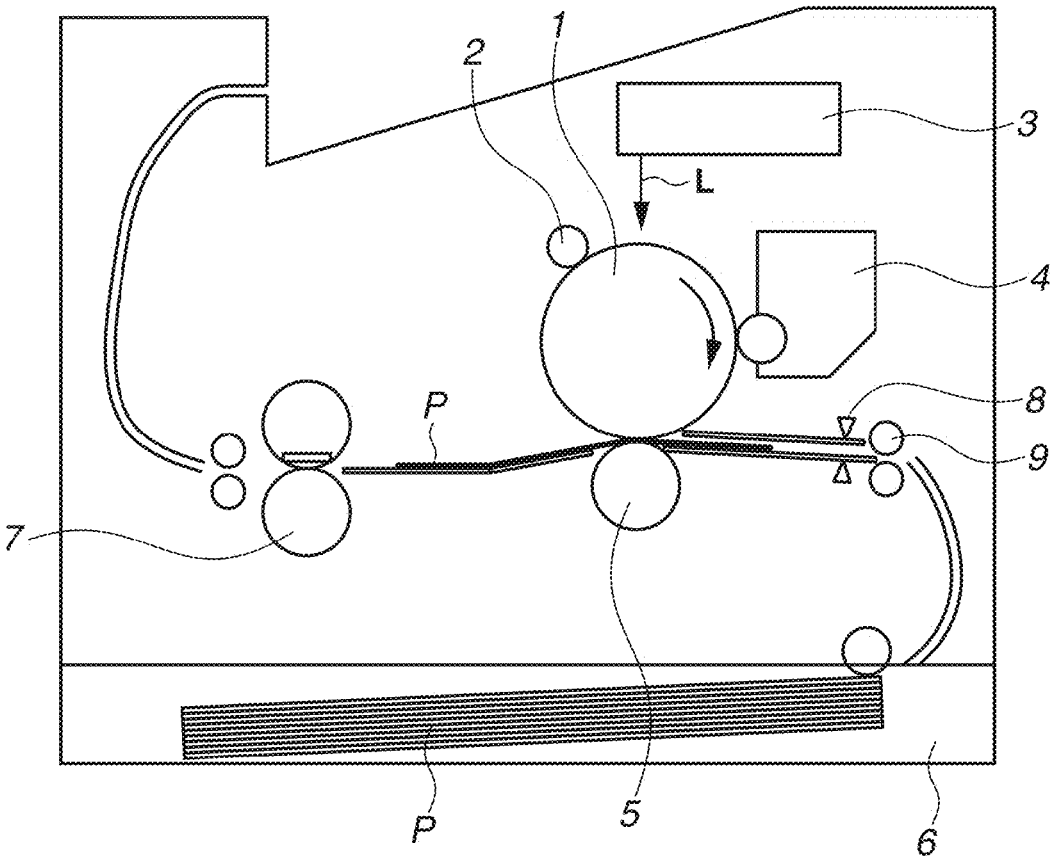
FIG. 1 is a schematic sectional view illustrating an image forming apparatus according to a first exemplary embodiment of the present invention.

FIG. 1 is a schematic configuration diagram illustrating a laser beam printer (hereinbelow, referred to as a printer) serving as an image forming apparatus according to a first exemplary embodiment. A photosensitive drum 1 is driven to rotate in an arrow direction, and the surface of the photosensitive drum 1 is evenly charged by a charging roller 2 as serving a charging device. A laser scanner 3 performs scanning exposure with a laser beam L which is on-and-off controlled according to image information, thereby forming an electrostatic latent image. A developing device 4 causes toner to adhere onto the electrostatic latent image to develop a toner image on the photosensitive drum 1. Then, at a transfer nip portion, which is a pressure contact portion between a transfer roller 5 and the photosensitive drum 1, the toner image formed on the photosensitive drum 1 is transferred onto a recording material P, which is a heated material conveyed from a sheet supplying cassette 6, at predetermined timing. At that time, for the purpose of synchronization, a top sensor 8 detects a leading end of the recording material P conveyed by a conveyance roller 9 so that a position where the toner image is formed on the photosensitive drum 1 is matched with a recording position of the leading end of the recording material P. The recording material P conveyed to the transfer nip portion at the predetermined timing is pinched and conveyed between the photosensitive drum 1 and the transfer roller 5 with a constant pressure. The recording material P onto which the toner image is transferred is conveyed to a fixing device 7, and the fixing device 7 heats the toner image to fix the toner image onto the recording material P. Then the recording material P is discharged on an output tray.

Figure 2:
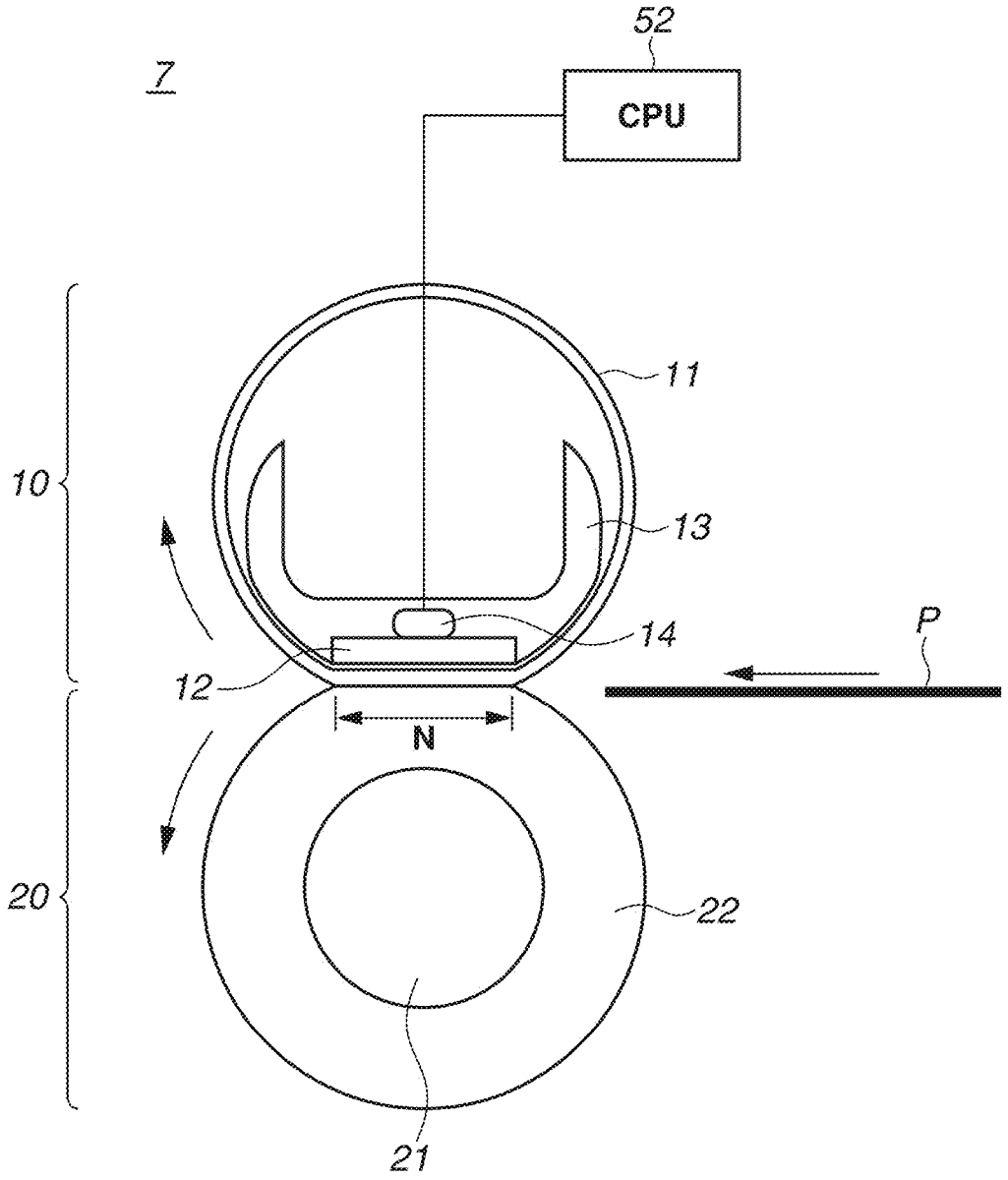
FIG. 2 is a schematic cross section illustrating a fixing device according to the first exemplary embodiment.

Next, the fixing device 7 according to the present exemplary embodiment will be described below. FIG. 2 is a sectional view of the fixing device 7. The fixing device 7 includes a cylindrical film 11, a heater 12 that is in contact with the inner surface of the film 11, and a pressure roller 20 that constitutes a fixing nip portion N together with the heater 12 via the film 11 therebetween.

The film 11 serving as a fixing member includes a base layer and a release layer that is formed outside the base layer. The base layer is made of a heat-resistant resin such as polyimide, polyamide-imide, and polyetheretherketone (PEEK). In the present exemplary embodiment, polyimide that is the heat-resistant resin having a thickness of 65 μm is used as the base layer. The release layer is formed by coating a single heat-resistant resin having a good release property, such as a fluororesin such as polytetrafluoroethylene (PTFE), p fluorophenylalanine (PFA), and fluorinated ethylene-propylene copolymer (FEP) and a silicone resin, or a combination thereof. In the present exemplary embodiment, the release layer is formed by coating PFA of the fluororesin having a thickness of 15 μm on the base layer. The film 11 of the present exemplary embodiment has a length of 240 mm in a lengthwise direction to be able to pass a letter size (width of 216 mm) sheet, and has an outer diameter of 24 mm.

A film guide 13 is a guide member for guiding the film 11 when rotating, and the film 11 is loosely fitted outside of film guide 13. In the present exemplary embodiment, the film guide 13 also has a roll of supporting a surface on an opposite side to a surface contacting the film 11 of the heater 12. The film guide 13 is made of a heat-resistant resin such as a liquid crystal polymer, a phenol resin, polyphenylene sulfide (PPS), and polyether ether ketone (PEEK).

The pressure roller 20 serving as a pressure member includes a core metal 21 and an elastic layer 22 that is formed outside the core metal 21. The core metal is made of metal such as steel use stainless (SUS), steel use machinability (SUM), and aluminum (Al). The elastic layer 22 is made of heat-resistant rubber such as silicone rubber and fluoro rubber, or formed by rubber made by foaming silicone rubber. The release layer made of PFA, PTFE, or FEP may be formed outside the elastic layer 22. The pressure roller 20 in the present exemplary embodiment has an outer diameter of 25 mm, and the elastic layer 22 is made of silicone rubber having a thickness of 3.5 mm. The elastic layer 22 has a length of 230 mm in the lengthwise direction. The film 11, the heater 12, and the film guide 13 are unitized into a film unit 10.

Both end portions in the lengthwise direction of the pressure roller 20 are pressurized toward the film unit 10 by pressure means (not illustrated). A driving force is transmitted from a driving source (not illustrated) to a gear (not illustrated) provided at an end portion in the lengthwise direction of the core metal 21, thereby rotating the pressure roller 20. The film 11 is driven to rotate according to the pressure roller by a frictional force received from the pressure roller 20 at the fixing nip portion N.

Figures 3A, 3B, 3C:
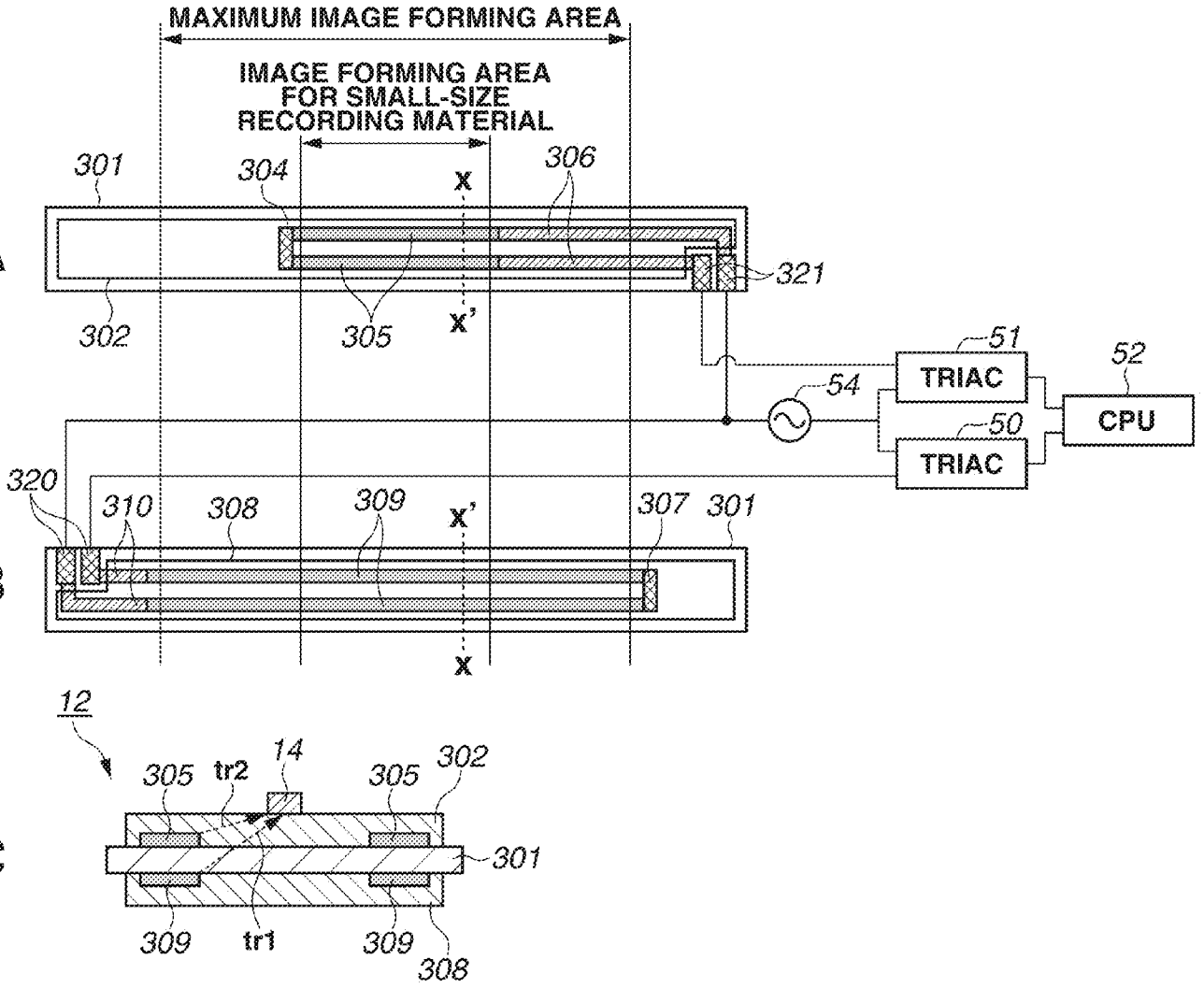
FIGS. 3A, 3B, and 3C are schematic configuration diagrams illustrating a heater according to the first exemplary embodiment.

The heater 12 according to the present exemplary embodiment will be described. FIG. 3A is a schematic plan view illustrating a surface (hereinbelow, referred to as a rear surface) on the opposite side to the surface contacting the inner surface of film 11 in the heater 12 according to the present exemplary embodiment. FIG. 3B is a schematic plan view illustrating a surface (hereinbelow, referred to as a front surface) contacting the inner surface of the film 11 in the heater 12. FIG. 3C is a schematic sectional view viewed when the heater 12 is cut along a line x-x' in FIGS. 3A and 3B.

A surface configuration of the heater 12 will be described with reference to FIG. 3B. A substrate 301 is a heat-resistant insulating material, and is made of a ceramic material such as alumina ($Al_2O_3$) and aluminum nitride (AlN). In the present exemplary embodiment, the substrate made of $Al_2O_3$, which has the width of 10 mm, the length of 270 mm in the lengthwise direction, and the thickness of 1 mm, is used as the substrate 301. A heating resistor 309 (first heat generating segment) corresponding to a size of a large-size recording material is formed on the front surface of the substrate 301 of the heater 12. The heating resistor 309 is formed by a screen printing of a conductive agent such as silver-palladium (Ag/Pd) and ruthenium oxide ($RuO_2$) and a heating resistor containing glass and polyimide with the thickness of about 10 μm. The heating resistor 309 is formed by arraying two heating resistors having the length of 225 mm and the width of 1.5 mm with a gap of 3.0 mm therebetween. The end portions of the two heating resistors are electrically connected to each other by a conductive pattern 307 having a resistance value lower than that of the heating resistor, whereby the two heating resistors 309 are formed into a U-shape, which is replicated in the lengthwise direction, as a whole. In the present exemplary embodiment, the resistance value of the heating resistor 309 is set to 12Ω. The reason why the length of the heating resistor for the large-size recording material is set to 225 mm in the present exemplary embodiment is that the fixing device needs to handle a letter size (width of 216 mm) and an A4 size (width of 210 mm), which are of a recording material size of the maximum width.

Conductive patterns 310 supply power to the heating resistor 309 through electrical contact patterns 320 constituting connector contact points. The conductive pattern 307, the conductive patterns 310, and the electrical contact patterns 320 are made of a material having the resistance value lower than that of the heating resistor 309. In the present exemplary embodiment, the conductive pattern 307, the conductive patterns 310, and the electrical contact patterns 320 are formed by the screen printing of paste containing mixed powder of silver (Ag) and platinum (Pt).

The heating resistor 309 is coated with a protective layer 308. The protective layer 308 is formed by a glass coating layer having a thickness of 65 μm to ensure an insulating property and a wear-resistant property against the heating film.

Next, a configuration of the rear surface of the heater 12 will be described below with reference to FIG. 3A. A heating resistor 305 (second heat generating segment) used for a small-size sheet is formed on the substrate 301 of the rear surface of the heater 12. The heating resistor 305 is formed by the screen printing of the heating resistor made of the same material as the heating resistor 309 formed on the front surface. The heating resistor 305 is formed by arraying two heating resistors having the length of 115 mm and the width of 1.5 mm with a gap of 3.0 mm therebetween. The end portions of the two heating resistors are electrically connected to each other by a conductive pattern 304 having the resistance value lower than that of the heating resistor 305, whereby the two heating resistors 305 are formed into the U-shape, which is replicated in the lengthwise direction, as a whole. In the present exemplary embodiment, the resistance value of the heating resistor 305 is set to 25Ω. The reason why the length of the heating resistor is set to 115 mm is that the fixing device needs to deal a small-size recording material such as an official postcard (width of 100 mm) and an A6 size (width of 105 mm). The first heat generating segment on the front surface of the heater 12 is larger than the second heat generating segment of the rear surface in the heat generation area.

Conductive patterns 306 are used to supply power to the heating resistor 305 for the small-size recording material, and electrical contact patterns 321 constitute the connector contact points for supplying power. In the present exemplary embodiment, the conductive pattern 304, the conductive patterns 306, and the electrical contact patterns 321 are formed by the screen printing of the paste containing mixed powder of Ag and Pt. A protective layer 302 is formed with the glass coating layer having the thickness of 65 μm similar to the protective layer 308.

Next, power control (heater control) of the heater 12, which is one of the features of the present exemplary embodiment, will be described. A thermistor 14 serving as a temperature detection unit is provided in the rear surface of the heater 12 to detect a temperature at the rear surface of the heater 12. The power supplied to the heater 12 is controlled so that a temperature detected by the thermistor 14 becomes a target temperature. An output signal of the thermistor 14 is input to a central processing unit (CPU) 52 serving as a controller. Based on the input signal, the CPU 52 controls the power supplied to the heating resistor 309 or 305 of the heater 12 through a triac 50 or 51 so that the detected temperature becomes the target temperature. At this time, alternating-current (AC) power is turned on and off by the triac, thereby controlling the power supplied to the heating resistor 305 or 309. The power supplied to the heating resistor 305 or 309 can independently be controlled, and which of the heating resistors 305 and 309 the power is supplied to depends on the size of the recording material.

The following two kinds of the heater control can be performed in the present exemplary embodiment. The first one is a control (first heater control) in which power is supplied only to the heating resistor 309 in the front surface of the heater 12 during the fixing processing of the large-size recording material (in the present exemplary embodiment, the recording material having the width of 115 mm or more). The second one is a control (second heater control) in which power is supplied only to the heating resistor 305 on the rear surface of the heater 12 during the fixing processing of the small-size paper (in the present exemplary embodiment, the recording material having the width of 115 mm or less). In the present exemplary embodiment, in a case where the fixing processing is performed on the same kind of the recording materials (the recording materials having the same physical properties such as surface roughness and a basis weight except for the size), the target temperature of the thermistor 14 is set in such a manner that the target temperature of the small-size recording material is higher than the target temperature of the large-size recording material. More specifically, in a case where the ratio between an amount of power supply (Df) supplied to the heating resistor 309 and an amount of power supply (Db) supplied to the heating resistor 305 has two stages of Df:Db=1:0 and Df:Db=0:1, the higher target temperature is set for Df:Db=0:1

The reason why the target temperature is set in this way will be described below with reference to FIG. 3C. In a case where the fixing processing is performed on the large-size recording material, power is supplied only to the heating resistor 309 on the front surface of the heater 12. The heat conduction path from the heating resistor 309 on the front surface of the heater 12 to the thermistor 14 on the rear surface of the heater 12 is a path from the heating resistor 309 to the thermistor 14 via the substrate 301 and the protective layer 302. It is assumed that tr1 is a thermal resistance of this heat conduction path. In a case where the fixing processing is performed on the small-size paper, power is supplied only to the heating resistor 305 on the rear surface of the heater 12. The heat conduction path from the heating resistor 309 on the rear surface of the heater 12 to the thermistor 14 reaches the thermistor 14 from the heating resistor 305 via the protective layer 302. It is assumed that tr2 is a thermal resistance of this heat conduction path. In the heater 12 in the present exemplary embodiment, the heating resistors 309 and 305 are formed at the same position in the widthwise direction. When the thermal resistances tr1 and tr2 are compared with each other, the thermal resistance tr1 is larger than the thermal resistance tr2 because the heat conduction path for the thermal resistance tr1 passes through the substrate 301. Accordingly, in the case where power is supplied only to the front surface of the heater 12, because the temperature detected by the thermistor 14 does not easily reach the target temperature compared with the case where power is supplied only to the rear surface of the heater 12, power cannot be reduced quickly, and the surface temperature on the film 11 is easily increased. On the other hand, in the case where power is supplied only to the rear surface of the heater 12, because the temperature detected by the thermistor 14 easily reaches the target temperature compared with the case where power is supplied only to the front surface of the heater 12, the supplied power can be reduced quickly, and the surface temperature on the film 11 is easily decreased.

The surface temperature on the film 11 necessary for the fixing of the toner to the recording material is the same when the large-size recording material and the small-size recording material are the same kind of the recording material. In the present exemplary embodiment, the target temperature is set so that the surface temperature on the film 11 becomes a temperature at which fixing is possible during the fixing processing of the large-size recording material. Accordingly, during the fixing processing of the small-size recording material, it is necessary to increase the heat generation amount of the heating resistor compared with the fixing processing of the large-size recording material so that the surface temperature on the film 11 is not lower than the temperature at which fixing is possible. Therefore, in the present exemplary embodiment, in the case where the fixing processing is performed on the small-size paper, the target temperature of the thermistor 14 is set higher than that in the case where the fixing processing is performed on the large-size recording material.

Figure 4A:
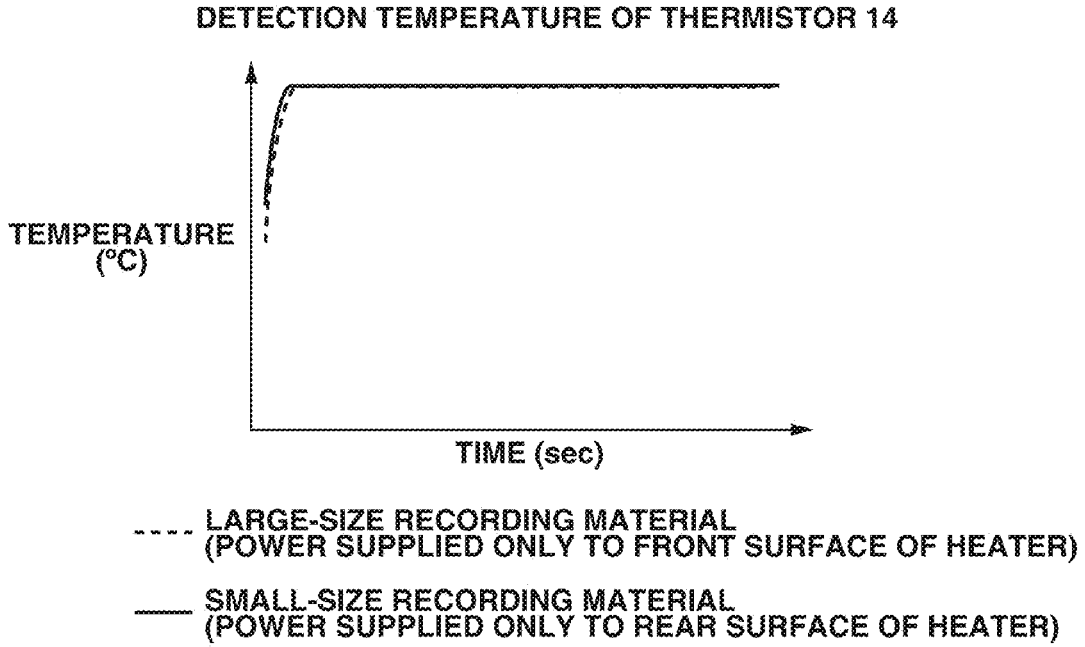
FIGS. 4A and 4B are graphs illustrating a temperature detected by a thermistor and a surface temperature of a film according to a comparative example of the first exemplary embodiment.
Figure 4B:
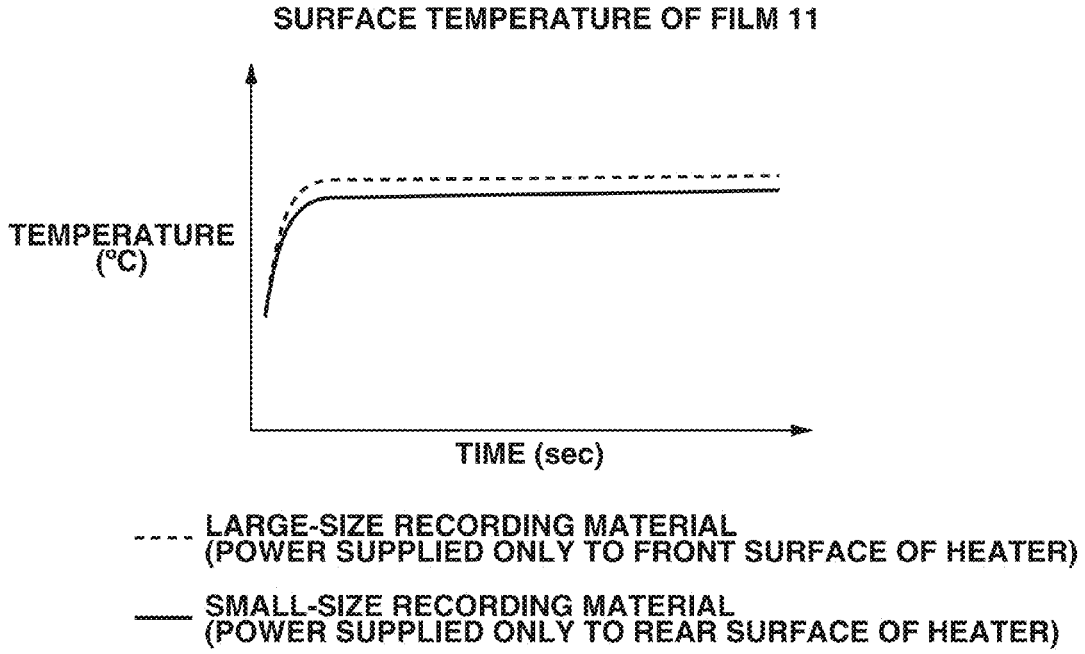

An advantageous effect of the present exemplary embodiment will be described below by comparing with a comparative example. In the comparative example, the target temperature of the thermistor 14 is set so that the target temperature during the fixing processing of the small-size recording material is equal to the target temperature during the fixing processing of the large-size recording material. FIGS. 4A and 4B are graphs respectively illustrating comparisons of the detection temperatures detected by the thermistor 14 and the surface temperatures on the film 11 between when the fixing processing for the large-size recording material is performed and the fixing processing for the small-size recording material is performed. At this time, the fixing processing is performed on the condition that FPOT becomes shortest by performing preheating of the fixing device. The preheating means controlling, while the rotations of the pressure roller 20 and film 11 are stopped, power to be supplied to the heater 12 so that the temperature detected by the thermistor 14 becomes a predetermined temperature.

In the comparative example, as illustrated in FIG. 4A, the temperature detected by the thermistor 14 during the fixing processing of the large-size recording material is substantially equal to the temperature detected by the thermistor 14 during the fixing processing of the small-size recording material. On the other hand, the surface temperature on the film 11 during the fixing processing of the small-size recording material is lower than the surface temperature on the film 11 during the fixing processing of the large-size recording material. Therefore, in the comparative example, when the target temperature of the thermistor 14 is set so that the surface temperature on the film 11 during the fixing processing of the large-size recording material becomes the temperature at which fixing is possible, sometimes the surface temperature on the film 11 during the fixing processing of the small-size recording material may be lower than the temperature at which fixing is possible. As a result, there is a possibility of generating an image defect such as a cold offset. On the other hand, when the target temperature of the thermistor 14 is set so that the surface temperature on the film 11 during the fixing processing of the small-size recording material becomes the temperature at which fixing is possible, sometimes the surface temperature on the film 11 during the fixing processing of the large-size recording material may be much higher than the temperature at which fixing is possible. As a result, there is a possibility of generating an image defect such as a hot offset.

Figure 5A:
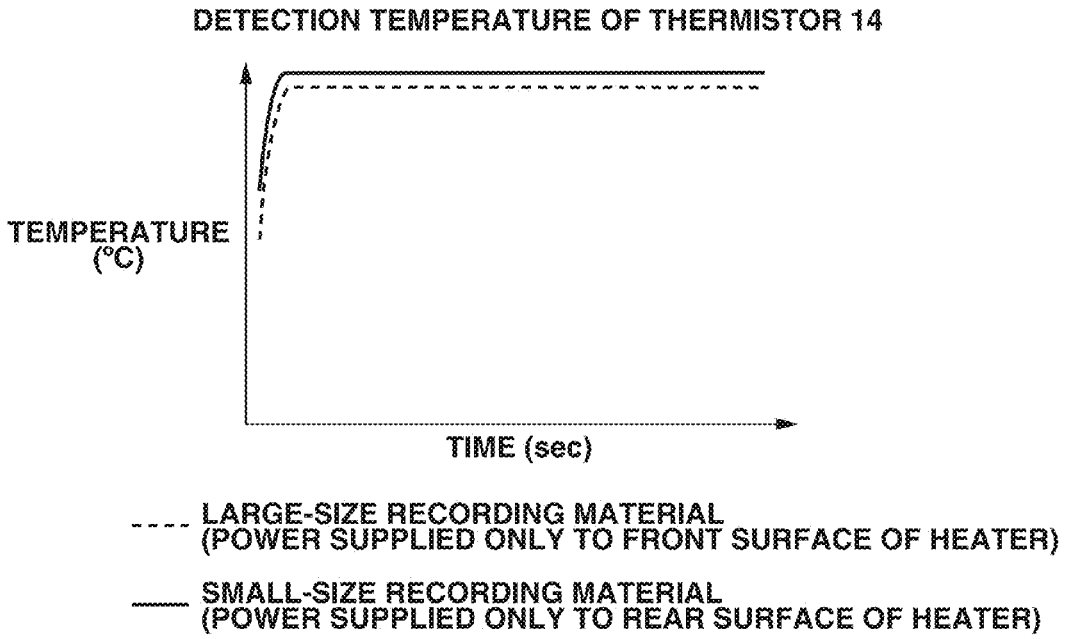
FIGS. 5A and 5B are graphs illustrating the temperature detected by the thermistor and the surface temperature of the film according to the first exemplary embodiment.
Figure 5B:
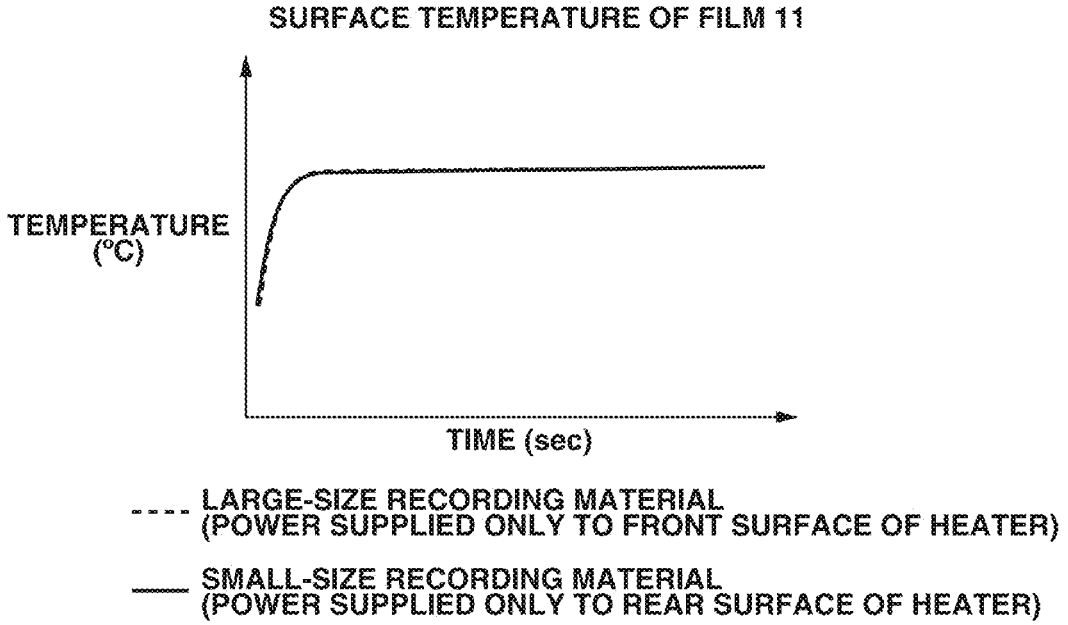

Therefore, in the present exemplary embodiment, the target temperature of the thermistor 14 is set so that the surface temperature on the film 11 during the fixing processing of the large-size recording material becomes the temperature at which fixing is possible. The target temperature of the thermistor 14 during the fixing processing of the small-size recording material is set higher than the target temperature of the thermistor 14 during the fixing processing of the large-size recording material by 10 degrees. FIGS. 5A and 5B are graphs respectively illustrating a comparison of the detection temperatures detected by the thermistor 14 and a comparison of the surface temperatures on the film 11 between when the fixing processing for the large-size recording material is performed and the fixing processing for the small-size recording material is performed, according to the present exemplary embodiment. The fixing processing condition is the same as that of the comparative example. As illustrated in FIG. 5A, the temperature detected by the thermistor 14 during the fixing processing of the small-size recording material is higher than the temperature detected by the thermistor 14 during the fixing processing of the large-size recording material. This is because the target temperature of the thermistor 14 during the fixing processing of the small-size paper is set higher than the target temperature of the thermistor 14 during the fixing processing of the large-size recording material by 10 degrees. On the other hand, the surface temperature on the film 11 during the fixing processing of the large-size recording material is substantially equal to the surface temperature on the film 11 during the fixing processing of the small-size recording material. This is because the target temperature of the thermistor 14 during the fixing processing of the small-size paper is set higher than the target temperature of the thermistor 14 during the fixing processing of the large-size recording material to increase the heat generation amount of the heating resistor 305 in the rear surface of the heater 12 compared with the case of the comparative example. As a result, the present exemplary embodiment is higher than the comparative example in surface temperature on the film 11 during the fixing processing of the small-size recording material, and the surface temperature on the film 11 during the fixing processing of the small-size recording material becomes substantially equal to the surface temperature on the film 11 during the fixing processing of the large-size recording material.

As described above, according to the present exemplary embodiment, the temperature on the film contacting the heater can be set to the temperature at which fixing is possible, even if power is supplied to any one of the heat generating segments formed on both surfaces of the heater in the fixing device.

In the present exemplary embodiment, the heating resistor corresponding to the large-size recording material is formed on the front surface of the heater 12, and the heating resistor corresponding to the small-size recording material is formed on the rear surface of the heater 12. However, the configuration is not limited thereto, and the heating resistor corresponding to the small-size recording material may be formed on the front surface of the heater 12 while the heating resistor corresponding to the large-size recording material may be formed on the rear surface of the heater 12.

The front surface and the rear surface of the heater 12 are not limited to correspond to the large-size and small-size recording materials, but the front surface and the rear surface of the heater 12 may be used in any purpose.

In the present exemplary embodiment, the heater control in which power is supplied only to the heat generating segment on the front surface of the heater and the heater control in which power is supplied only to the heat generating segment in the rear surface of the heater are described. However, it is not limited thereto. Alternatively, for example, the target temperature during the heater control in which power supplied to the heat generating segment on the rear surface of the heater is larger than power supplied to the heat generating segment on the front surface of the heater may be set higher than the target temperature during the heater control in which power supplied to the heat generating segment on the rear surface of the heater is smaller than the power supplied to the heat generating segment on the front surface of the heater.

A configuration of a fixing device according to a second exemplary embodiment is to the same as that of the first exemplary embodiment except for the configuration and control of the heater. Accordingly, components having configurations common to those of the first exemplary embodiment are designated by the same reference numerals, and the description thereof is omitted.

In the first exemplary embodiment, the target temperature is set in the case where the ratio of the amount of power supply (Df) supplied to the heating resistor formed on the front surface of the heater and the amount of power supply (Db) supplied to the heating resistor formed on the rear surface has the two stages of Df:Db=1:0 and Df:Db=0:1.

Figure 6A:
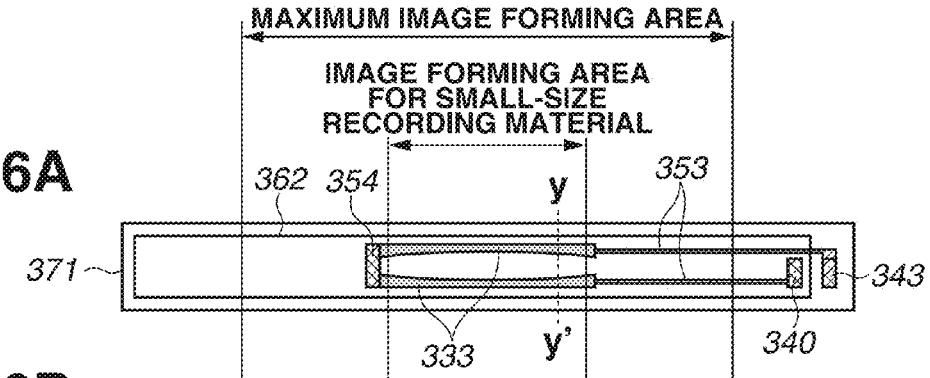
FIGS. 6A, 6B, 6C, and 6D are schematic configuration diagrams illustrating a heater according to a second exemplary embodiment.
Figure 6B:
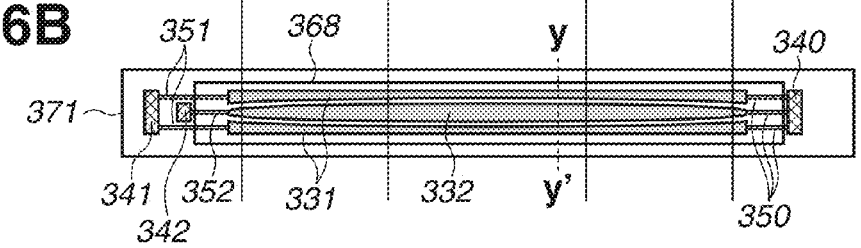
Figure 6C:
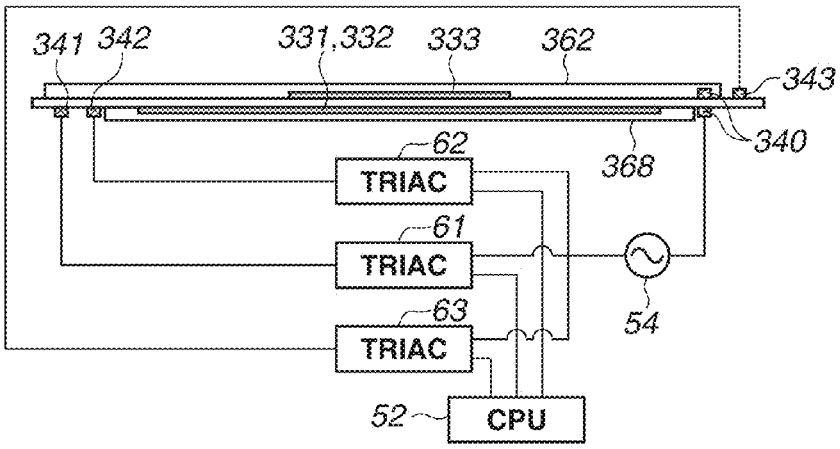
Figure 6D:
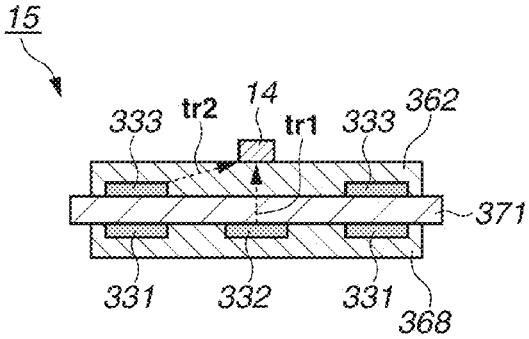

In the present exemplary embodiment, the target temperature is set in a case where the ratio of Df and Db is not only Df:Db=1:0 and Df:Db=0:1 but also a multi-stage such as Df:Db=0.5:1. FIG. 6A is a schematic plan view illustrating the rear surface of a heater 15 according to the present exemplary embodiment. FIG. 6B is a schematic plan view of the front surface of the heater 15. FIG. 6C is a schematic diagram of a cross section of the heater 15. FIG. 6D is a schematic sectional view when the heater 15 is cut along a line y-y' in FIGS. 6A and 6B. On the front surface of a substrate 371, a heating resistor (first heat generating segment) for the large-size recording material is formed with the length of 225 mm along the lengthwise direction of the substrate 371. The heating resistor for the large-size recording material includes two heating resistors 331 and one heating resistor 332. The two heating resistors 331 differ from each other in width in the widthwise direction of the substrate 371 from the center portion to the end portion thereof in the lengthwise direction of the substrate 371. The heating resistor 331 is formed along the lengthwise direction at both end portions in the widthwise direction of the substrate 371. The heating resistor 331 has the width in the widthwise direction of the heating resistor widened toward the end portion from the center portion thereof in the lengthwise direction of the substrate 371. On the other hand, the heating resistor 332 is formed along the lengthwise direction between the two heating resistors 331 in the widthwise direction. The heating resistor 332 has the width in the widthwise direction of the heating resistor narrowed toward the end portion from the center portion thereof in the lengthwise direction of the substrate 371. The heating resistors 331 and the heating resistor 332 are arrayed in the widthwise direction of the substrate 371. The heating resistors 331 and the heating resistor 332 are disposed in a line-symmetry manner with respect to a center in the lengthwise direction of the substrate 371.

On the front surface of the substrate 371, one of the end portions of the heating resistor 331 is connected to an electrical contact portion 340 via a conductive patterns 350, and the other end portion is connected to an electrical contact portion 341 via a conductive patterns 351. One of the end portions of the heating resistor 332 is connected to the electrical contact portion 340 shared by the heating resistors 331 via the conductive pattern 350. The other end portion of the heating resistor 332 is connected to an electrical contact portion 342 via a conductive pattern 352. The electrical contact portion 341 and the electrical contact portion 342 are provided in one of the end portions in the lengthwise direction of the substrate 371, and the electrical contact portion 340 is provided in the other end portion of the substrate 371.

On the rear surface of the substrate 371, heating resistors 333 (second heat generating segment) are formed with the length of 115 mm along the lengthwise direction of the substrate 371. The heating resistors 333 are disposed in the line-symmetry manner with respect to the center in the lengthwise direction of the substrate 371. The heating resistors 333 each have the width in the widthwise direction of the substrate 371 narrowed toward the end portion from the center portion thereof in the lengthwise direction of the substrate 371, and the heat generation amount increases according thereto. On the rear surface of the substrate 371, electrical contact portions 340 and 343 for the heating resistors 333 are formed at one of the end portions in the lengthwise direction of the substrate 371. The electrical contact portion 340 on the rear surface of the substrate 371 is electrically connected to the electrical contact portion 340 on the front surface of the substrate 371 via a through-hole in the substrate 371.

Figure 7:
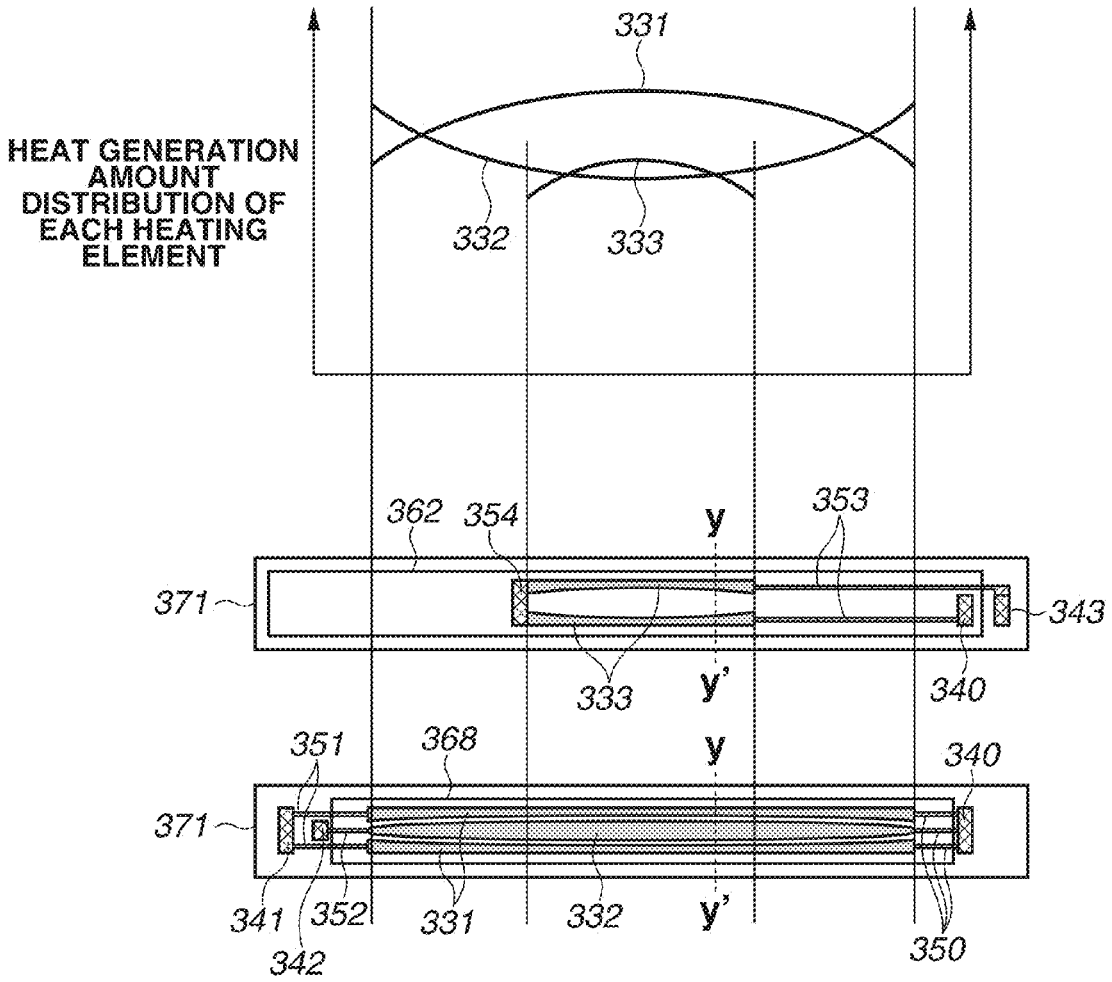
FIG. 7 is a diagram illustrating a heat generation amount distribution in a lengthwise direction of each heating resistor in the heater according to the second exemplary embodiment.

FIG. 7 illustrates a heat generation amount distribution in the lengthwise direction for the heating resistors 331, 332, and 333. In the heating resistors 331, the heat generation amount increases gradually from the end portion toward the center portion thereof in the lengthwise direction. In the heating resistor 332, the heat generation amount decreases gradually from the end portion toward the center portion thereof in the lengthwise direction. In the heating resistors 333, the heat generation amount increases gradually from the end portion toward the center portion thereof in the lengthwise direction.

The heating resistors 331, 332, and 333 are connected to triacs 61, 62, and 63, respectively. Therefore, the CPU 52 controls powers D1, D2, and D3 supplied to the heating resistors 331, 332, and 333 using the triacs 61, 62, and 63, respectively.

In the present exemplary embodiment, a ratio of the powers (D1+D2) supplied to the heating resistors 331 and 332 on the front surface and the power (D3) supplied to the heating resistor 333 on the rear surface is set to 1:0 in a case where the fixing processing is performed on the large-size recording material. In other words, power is supplied only to the heating resistors 331 and 332 on the front surface of the heater 15. The controller can also change a ratio of D1 and D2. Accordingly, the heat generation amount distribution in the lengthwise direction can have any gradient on the front surface of the heater 15. In the direction orthogonal to the recording material conveyance direction, the width of the recording material is larger than the length of the heating resistors 333 of the heater 15, so that the temperature raise can be suppressed in a non-sheet passing portion of the recording material (in the present exemplary embodiment, the recording material ranges from 115 mm to 216 mm) having the maximum width that can be conveyed by the fixing device.

On the other hand, the ratio of the powers (D1+D2) supplied to the heating resistors 331 and 332 on the front surface and the power (D3) supplied to the heating resistors 333 on the rear surface is set to $\gamma$:1 ($0 \leq \gamma \leq 1$) in a case where the fixing processing is performed on the small-size recording material (the recording material having the width of 115 mm or less). The heat generation amount of the heater 15 can be suppressed in the area outside the width of the small-size recording material while any heat generation amount distribution in the lengthwise direction is formed in the area of the width of the small-size recording material. In the present exemplary embodiment, in a case where the fixing processing is performed on the small-size recording material, the power (D1) is set to zero because the heating resistors 331, in which the heat generation amount increases gradually from the center portion toward the end portion thereof in the lengthwise direction, do not generate the heat. Therefore, the temperature raise can be suppressed in the non-sheet passing portion of the recording material of which the width is less than or equal to the width (115 mm or less) of the heating resistors 333.

Figure 8A:
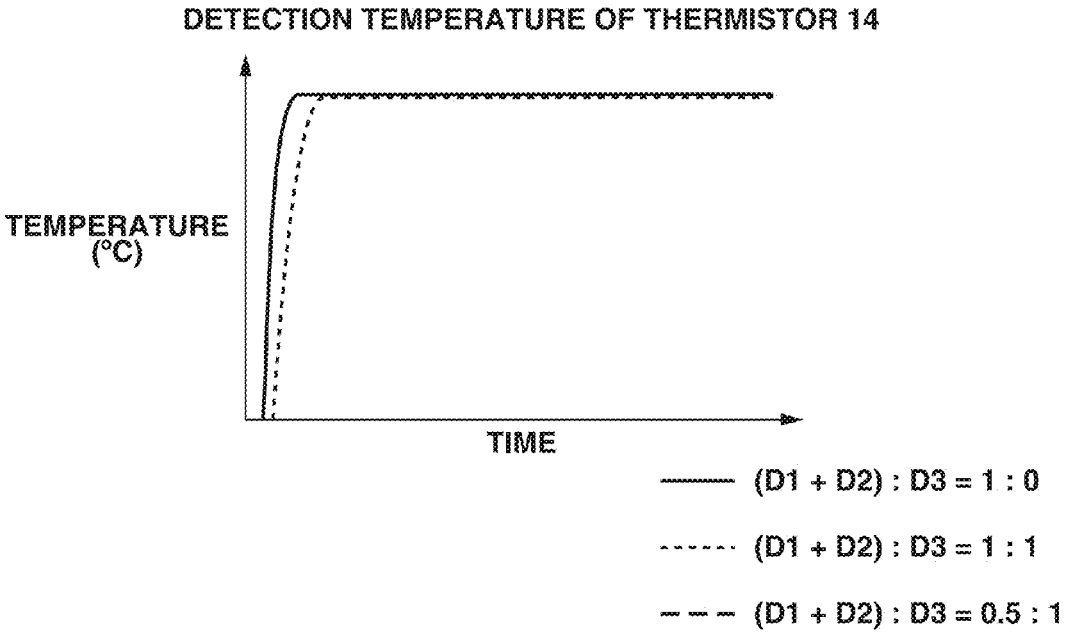
FIGS. 8A and 8B are graphs illustrating a temperature detected by a thermistor and a surface temperature of a film according to a comparative example of the second exemplary embodiment.
Figure 8B:
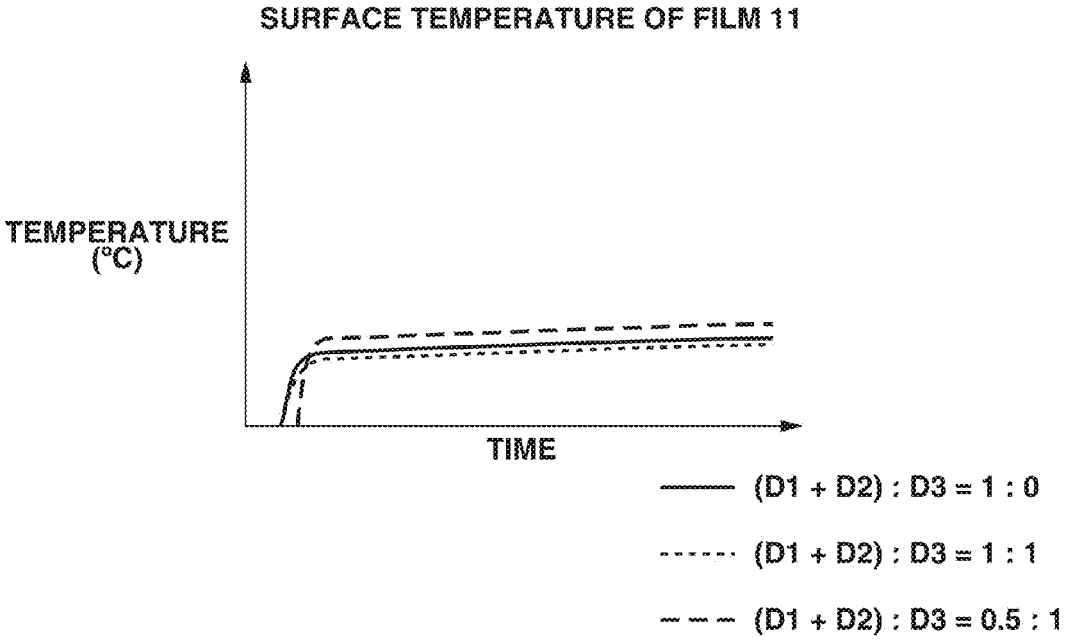

An experiment performed by the inventor shows that the surface temperature on the film 11 changes when the fixing processing is performed by changing the power ratio of (D1+D2):D3 while the target temperature of the thermistor 14 is kept constant. FIGS. 8A and 8B respectively illustrate the temperature detected by the thermistor and the temperature on the film 11 according to a comparative example of the present exemplary embodiment.

FIG. 8A illustrates the temperature detected by the thermistor 14 when fixing processing is performed on a letter-size recording material (width of 216 mm) as a large-size recording material, and an A6-size recording material (width of 105 mm) and an index card (width of 76.2 mm) as a small-size recording material. FIG. 8B is a graph illustrating the surface temperature on the film 11 at that time. The letter-size recording material, the A6 recording material, and the index card are substantially to the same as one another in basis weight and surface property. The ratio of powers supplied to the respective heating resistors is set respectively to (D1+D2):D3=1:0 for the letter-size paper, to (D1+D2):D3=1:1 for the A6-size paper, and to (D1+D2):D3=0.5:1 for the index card.

The temperature detected by the thermistor 14 indicates the same value irrespective of the power ratio because the target temperature is kept constant. On the other hand, the surface temperature on the film 11 depends on the supplied power ratio. During the fixing processing of the small-size recording material, the surface temperature on the film 11 tends to increase with decreasing value of the above $\gamma$.

The reason therefor will be described below. As illustrated in FIG. 6D, a protective layer 362 having thermal conductivity of $1.4\times10^{-3}$ W/mm·k exists in a heat conduction path to the thermistor 14 from the heating resistors 333 on the rear surface of the heater 15, and the distance between the thermistor 14 from the heating resistors 333 is about 1.4 mm in the present exemplary embodiment. Therefore, a thermal resistance tr1 between the heating resistor 333 and the thermistor 14 can be calculated as 990 $mm^2$·k/W. On the other hand, the substrate 371 having thermal conductivity of $2.6\times10^{-2}$ W/mm·k and the protective layer 362 having thermal conductivity of $1.4\times10^{-3}$ W/mm·k exist in a heat conduction path to the thermistor 14 from the heating resistor 332 on the front surface of the heater 15. The heat generated from the heating resistor 332 is conducted through the substrate 371 by a distance of 1 mm, and conducted through the protective layer 362 by a distance of 0.065 mm. Therefore, a thermal resistance tr2 between the heating resistors 332 and the thermistor 14 can be calculated as 85 $mm^2$·k/W. Thus, the thermal resistance tr2 between the heating resistors 333 and the thermistor 14 is at least ten times the thermal resistance tr1 between the heating resistor 332 and the thermistor 14. The temperature detected by the thermistor 14 easily reaches the target temperature with increasing ratio ($\gamma$) of power supplied to the heating resistor 332 in which the heat is easily conducted to the thermistor 14 compared with the heating resistors 333. As a result, the power supplied to the heater 15 is reduced to lower the surface temperature on the film 11. On the other hand, the temperature detected by the thermistor 14 does not easily reach the target temperature with decreasing ratio ($\gamma$) of the power supplied to the heating resistor 332 to the power supplied to the heating resistors 333. Therefore, the power supplied to the heater 15 increases to raise the surface temperature on the film 11.

As described above, for the same kind of the recording materials having different sizes, when the power ratio is changed according to the size of the recording material, there is a problem in that the surface temperature on the film 11 is changed to generate the hot offset or the cold offset.

Therefore, in the present exemplary embodiment, the target temperature is set to a first target temperature so that the temperature on the film 11 for $\gamma$=1.0 becomes the temperature at which fixing is possible. The target temperature is set to a second target temperature so that the temperature on the film 11 for $\gamma$=0.5 becomes not excessively higher than the temperature at which fixing is possible. In other words, in the present exemplary embodiment, the target temperature is lowered as the power supplied to the heating resistor having the smaller thermal resistance in the heat conduction path to the thermistor decreases with respect to the power supplied to the heating resistor having the larger thermal resistance among the heating resistors on the front surface and rear surface of the heater.

In the present exemplary embodiment, the following advantageous effect is obtained in the fixing device including the heater in which the heat generating segments are formed on both surfaces. The temperature at the film contacting the heater can be set to the temperature at which fixing is possible irrespective of the ratio of the power supplied to the heat generating segment in one of the surfaces of the heater and the power supplied to the heat generating segment in the other surface.

A configuration of a fixing device according to a third exemplary embodiment is to the same as that of the first exemplary embodiment except for the configuration and control of the heater. Accordingly, the components having the configurations common to those in the first exemplary embodiment are designated by the same reference numerals, and the descriptions thereof are omitted.

One of the features of the present exemplary embodiment is that, in a case where the target temperature of the thermistor 14 is corrected according to a heat storage amount of a fixing device, a correction amount is changed according to the ratio of the amount of power supply (Df) supplied to the heating resistor on the front surface and the amount of power supply (Db) supplied to the heating resistor on the rear surface even in the same heat storage amount.

Nowadays, the power is often not supplied to the fixing device in the standby state in order to suppress power consumption as much as possible. Therefore, the fixing processing is often started while fixing device is relatively cool. For the fixing device according to the present exemplary embodiment, a fixing property of the toner to the recording material is sensitive to the temperature of the pressure roller. Because the temperature of the pressure roller is low for a first paper, a small amount of heat is supplied from the pressure roller to the recording material to easily causing the fixing defect. For this reason, the target temperature of the thermistor 14 is desirably raised to improve the fixing property. On the other hand, when the fixing processing is continuously performed on a plurality of recording materials, the temperature of the pressure roller is raised to increase a heat supply amount from the pressure roller to the recording material. Therefore, the surface temperature on the film is also raised to easily generate the hot offset. For this reason, in a case where the fixing processing is continuously performed, the target temperature of the thermistor 14 is desirably lowered according to the number of recording materials to be continuously processed, and the temperature raise is suppressed on the surface of the film to suppress the generation of the hot offset. In a case where fixing processing is intermittently performed, the target temperature of the thermistor 14 is desirably set according to the temperature of the pressure roller. Therefore, in the present exemplary embodiment, a warm air count value α, which is calculated in consideration of the number of recording materials subjected to fixing processing and a standby time, is introduced to predict the temperature of the pressure roller. The target temperature of the thermistor is determined according to the warm air count value α.

A method for managing the warm air count value α will be described below. The warm air count value α is incremented by +1 every time the fixing processing is performed on the one recording material, and the warm air count value α increases with increasing number of recording materials subjected to the fixing processing. On the other hand, in the standby state after the fixing processing, the pressure roller is naturally cooled, and the warm air count value α is counted down with time. More specifically, a cooling property of the pressure roller is previously checked, and the warm air count value α is subtracted using an arithmetic equation as a function of an elapsed time. The temperature of the pressure roller can be predicted by managing the warm air count value α.

Figure 9:
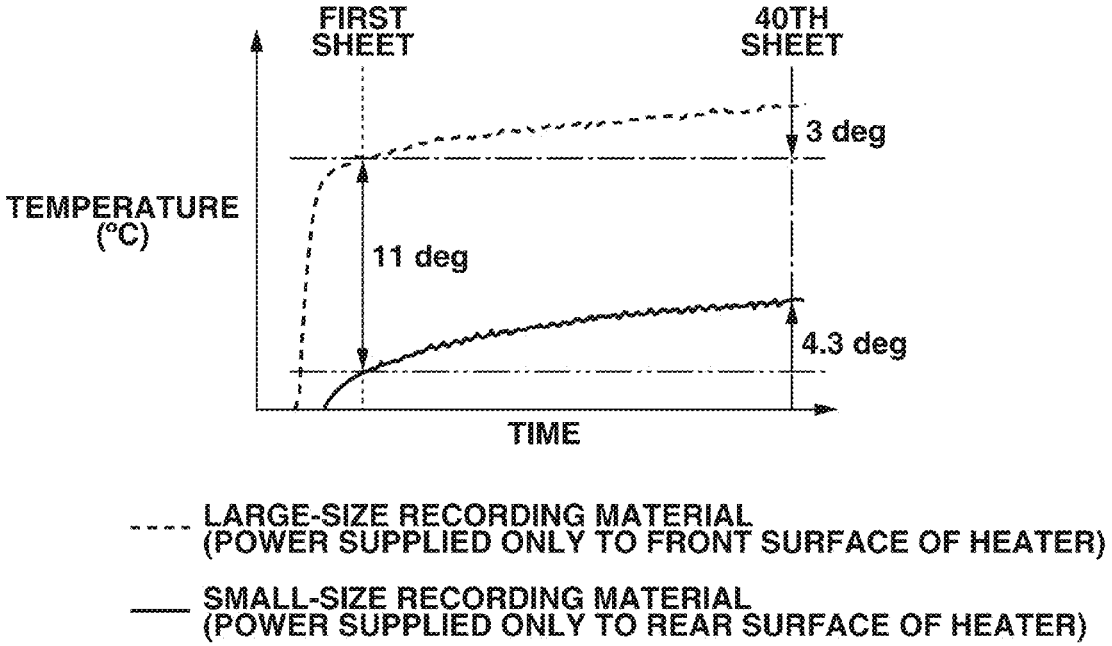
FIG. 9 is a graph illustrating a surface temperature of a film in continuous fixing processing according to a comparative example of a third exemplary embodiment.

The following fact is found by the experiment performed using the fixing device of the first exemplary embodiment. A case where fixing processing is continuously performed on the large-size recording material (power is supplied only to the heating resistors 309) differs from a case where fixing processing is continuously performed on the small-size paper (power is supplied only to the heating resistors 305) in transition of the temperature raise on the front surface of the film 11. FIG. 9 is a graph illustrating a transition of the surface temperature on the film 11 when fixing processing is continuously performed on the plurality of large-size recording materials that is of the same kind of recording material and the plurality of small-size recording materials that is of the same kind of recording material (a comparative example of the present exemplary embodiment). At this time, the printing is started while the temperature at the fixing device is adapted to the room temperature, and the target temperature of the thermistor 14 is set to the same value for the large-size recording material and the small-size recording material. When the 40th film 11 is compared to the first film 11 with respect to the surface temperature raise, the surface temperature is raised by 3 degrees during the fixing processing of the large-size recording material, and the surface temperature is raised by 4.3 degrees during the fixing processing of the small-size recording material. Thus, the small-size recording material is larger than the large-size recording material in an amount of the surface temperature raise of the film. In the first film, the surface temperature on the film 11 during the fixing processing of the small-size recording material is lower than the surface temperature on the film 11 during the fixing processing of the large-size recording material by degrees. This shows that, similar to the first exemplary embodiment, it is necessary to raise the target temperature during the fixing processing of the small-size recording material.

Accordingly, in the present exemplary embodiment, the target temperature of the thermistor 14 is set similarly to the first exemplary embodiment so that the small-size recording material is equal to the large-size recording material of the front surface temperature at the first film 11. Additionally, in the present exemplary embodiment, the correction amount of the target temperature of the thermistor 14 is changed according to the warm air count value α during the fixing processing of the large-size recording material and the fixing processing of the small-size recording material. The specific correction quantity is set as illustrated in Table 1.

TABLE 1

| | Target temperature correction amount (° C.) | | | | | |
|---|---|---|---|---|---|---|
| Warm air count value α<br>Fixing processing mode | 0 to 19 | 20 to 39 | 40 to 99 | 100 to 199 | 200 to 399 | from 400 |
| Large-size recording material | 0 | −4 | −5 | −7 | −9 | −11 |
| Small-size recording material | 0 | −5 | −7 | −9 | −11 | −14 |

Figure 10:
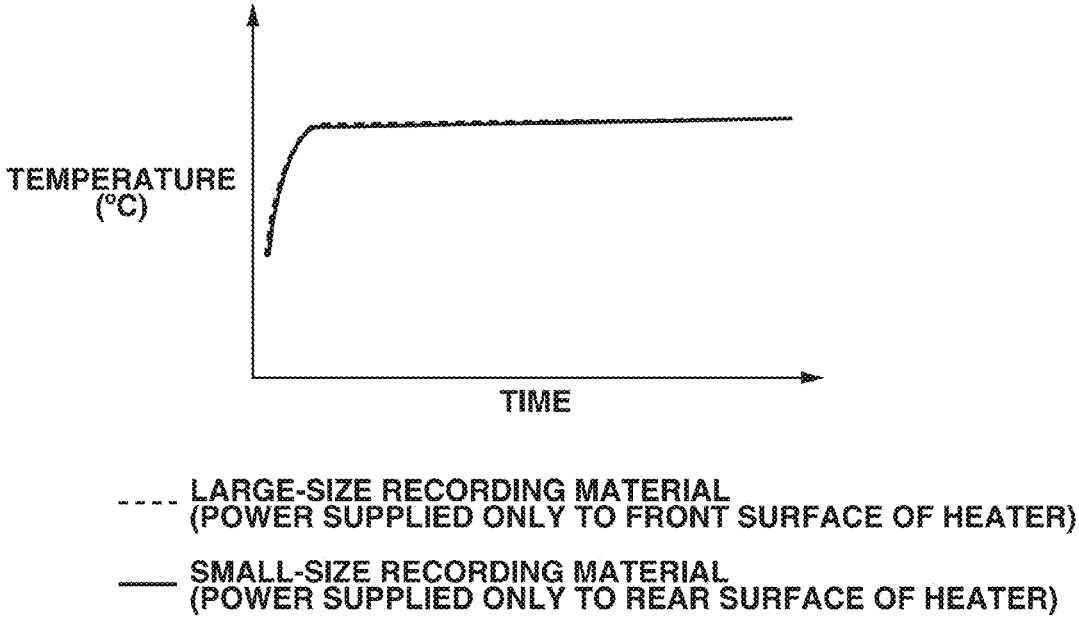
FIG. 10 is a graph illustrating a surface temperature of a film in continuous fixing processing according to the third exemplary embodiment.

Next, the advantageous effect of the present exemplary embodiment will be described. FIG. 10 is a graph illustrating transitions of the surface temperatures on the film 11 when fixing processing is performed on the large-size and small-size recording materials that are of the same kind of recording materials, using the present exemplary embodiment. The fixing processing is started while the temperature at the fixing device is adapted to the room temperature. The surface temperature on the film 11 during the fixing processing of the large-size recording material is substantially equal to the surface temperature on the film 11 during the fixing processing of the small-size recording material. The target temperature is corrected according to the warm air count value α during the fixing processing of the large-size recording material and the fixing processing of the small-size recording material. Therefore, the surface temperature on the film 11 during the fixing processing of the large-size recording material and the surface temperature on the film 11 during the fixing processing of the small-size recording material can be constant in the continuous fixing processing.

As described above, according to the present exemplary embodiment, the temperature at the film contacting the heater can be set to the temperature at which fixing is possible irrespective of the warming-up state of the fixing device even if power is supplied to any one of the heat generating segments formed on both surfaces of the heater.

In the present exemplary embodiment, the warm air count value α is used as a parameter expressing the heat storage amount of the fixing device, but is not limited thereto. Alternatively, for example, at least one of the number of recording materials to be printed, a print time, a stopping time of the fixing device, and a power supply time period or power not supplied time period to the heating resistor may be used as the parameter. Additionally, the temperature at the component, which constitutes the fixing device, such as the pressure roller, may directly be detected.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-027830, filed Feb. 16, 2015, which is hereby incorporated by reference herein in its entirety.

What is claimed is:

1. A fixing device for fixing a toner image onto a recording material while conveying and heating the recording material on which the toner image has been formed at a nip portion, the fixing device comprising:

a cylindrical film;

a heater configured to contact the film, the heater including a substrate, a first heat generating segment formed on a first surface, facing the film, of the substrate, and a second heat generating segment formed on a second surface opposite to the first surface of the substrate;

a pressure member configured to form the nip portion with the film;

a temperature detection unit configured to detect the second surface; and a control unit configured to supply power to the heater so that the temperature detected by the temperature detection unit becomes a target temperature, wherein the control unit can perform a first heater control for controlling the heater so as to supply power only to the first heat generating segment, and a second heater control for controlling the heater so as to supply power only to the second heat generating segment, and wherein the target temperature during performing the second heater control is higher than the target temperature during performing the first heater control.

2. The fixing apparatus according to claim 1, wherein a length of a heat generation area of the second heat generating segment in a direction orthogonal to a recording material conveyance direction is shorter than a length of a heat generation area of the first heat generating segment.

3. The fixing apparatus according to claim 1, wherein the control unit performs the first heater control in a case where fixing processing is performed on a first recording material, and the control unit performs the second heater control in a case where the fixing processing is performed on a second recording material having a width in the direction orthogonal to the recording material conveyance direction narrower than that of the first recording material.

4. The fixing apparatus according to claim 1, wherein the first heat generating segment includes a first heating resistor which has a larger amount of heat generation at center portion thereof than at an end portion thereof in a direction orthogonal to a recording material conveyance direction, and a second heating resistor which has a smaller amount of heat generation at a center portion than that at an end portion thereof in the direction orthogonal to the recording material conveyance direction, and wherein the control unit independently supplies power to the first heating resistor and the second heating resistor.

5. The fixing apparatus according to claim 4, wherein the second heat generating segment includes a third heating resistor which has a larger amount of heat generation at a center portion thereof than at an end portion thereof in the direction orthogonal to the recording material conveyance direction.

6. The fixing apparatus according to claim 1, wherein the pressure member is a roller, and wherein the heater forms the nip portion together with a roller via the film.

* * * * *